United States Patent [19]

Nilsson et al.

[11] Patent Number: 4,750,730

[45] Date of Patent: Jun. 14, 1988

[54] ARRANGEMENT FOR THE HANDLING OF STACKED SHEETS

[75] Inventors: Ingvar Nilsson, Akarp; James Johansson, Furland, both of Sweden

[73] Assignee: Svecia Antiqua SA, Fribourg, Switzerland

[21] Appl. No.: 936,742

[22] Filed: Dec. 2, 1986

[30] Foreign Application Priority Data

Dec. 20, 1985 [SE] Sweden ..... 8506049

[51] Int. Cl.[4] ..... B65H 3/12

[52] U.S. Cl. ..... 271/96; 271/34; 271/108

[58] Field of Search ..... 271/94, 96, 34, 108

[56] References Cited

U.S. PATENT DOCUMENTS 2,877,015 3/1959 Trimble ..... 271/94 X 3,126,199 3/1964 Rosoff ..... 271/94 X 4,184,670 1/1980 Rosendahl ..... 271/94 X 4,345,752 8/1982 Nakamura ..... 271/94 X

*Primary Examiner*—Richard A. Schacher

*Attorney, Agent, or Firm*—Burns, Doane, Swecker & Mathis

[57] ABSTRACT

An arrangement for separating of individual sheets from a stack of sheets, this arrangement comprising a rotatable pulley close to the uppermost sheet, which as a system of ducts connectable to a source of vacuum, with one or more openings which open out onto the periphery of the pulley, and an endless belt driven slip-free round the pulley with through-perforated holes which are arranged so as to coincide with the said opening of openings on the pulley to form suction elements to make possible the lifting off of sheets, one-by-one, from the stack.

5 Claims, 1 Drawing Sheet

ARRANGEMENT FOR THE HANDLING OF STACKED SHEETS

BACKGROUND OF THE INVENTION

The present invention relates to apparatus for separating and conveying sheets from a stack, this apparatus comprising vacuum-operated suction elements for lifting individual sheets from the stack.

Apparatus for separating stacked sheets is frequently used in conjunction with a machine, which is to be fed with individual sheets from a stack of sheets, so as to provide feeding of such sheets to the machine. The machines concerned may be simple machines fed with sheets, e.g. copying machines which usually contain a magazine with stacked copying sheets and which are to be fed with copying sheets one at a time in accordance with some specified feeding scheme, or more sophisticated machines which by means of one or more working operations convert or process premanufactured sheet blanks to finished products and which for the effective utilization of the capacity of the machine require continuous feeding of individual sheet blanks in rhythm with the working speed of the machine.

When it is a matter of feeding stacked sheets of thin paper or similarly flexible material, for example, into a copying machine, the sheet-separating arrangement used normally is of the kind which typically comprises a friction element on a reciprocating sheet-conveying arm and which, by means of the friction element, is pressed into a slip-free engagement with the top side of the uppermost sheet to be drawn by this against the sheet directly underneath it from the stack. This arrangement certainly is rapid and simple, but it happens not infrequently that not only the uppermost, but also one or more of the sheets directly underneath it follow along when the uppermost sheet is being removed. The tendency to such unintentional double-feeding of sheets increases for obvious reasons when particularly tightly packed stacks of sheets with coarse or rough surfaces are involved.

On the other hand, when it is a matter of stacked sheets of cardboard, carton or similar rigid and self-supporting material, a conventional arrangement is used instead of the kind which typically comprises vacuum-operated suction elements in the form of funnels, cups or similarly dished elements on movable lifting arms and which, by means of the suction elements in vacuum-engagement with the uppermost sheet, lifts the latter off the sheet stack. This type of sheet-separating arrangement presents less tendency to double-feed the sheets but, on the other hand, is technically more complicated than the known arrangement of the friction type and requires, among other things, a relatively complicated valve arrangement for controlling the vacuum operation of the suction elements in correct rhythm with the working motions of the lifting arms. Moreover, it is is somewhat slower than the former arrangement and frequently also space-demanding, if sufficient swing room for the movements of the lifting arms is to be provided. Furthermore, it needs regular supervision and ajustment of the suction elements which in most cases are liable to wear.

SUMMARY OF THE INVENTION

It is an object of the present invention, therefore, to provide apparatus for sheet separation which possesses a combination of the advantageous properties of both the known arrangements described above, such as simplicity, rapidity and, practically speaking, limiting the risk of double-feeding.

It is another object to provide apparatus for sheet separation of the type which comprises vacuum-operated suction elements for lifting sheets one-by-one off a stack of sheets, but which, by contrast with the conventional arrangement of the lifting type, is less liable to wear and less space-demanding.

These objects are achieved in accordance with the present invention by means of apparatus of the type which comprises vacuum-operated suction elements for lifting sheets one-by-one from a stack of sheets and which has been given the characteristic that it comprises an endless belt, driven slip-free round a rotatable feed pulley close to the uppermost sheet, that the feed pulley comprises a system of ducts, connectable to a source of vacuum, with at least one peripheral opening and that the belt has through-perforated holes coinciding with the opening or openings on passing round the feed pulley to form the said suction elements.

BRIEF DESCRIPTION OF THE DRAWING FIGURES

The invention, alongside with practically advantageous embodiments of the same, will be explained and described in more detail in the following with reference to the attached drawing, wherein:

FIG. 1 illustrates schematically apparatus in accordance with a preferred embodiment of the invention; and FIG. 2 illustrates in greater detail a sectional view of the apparatus of FIG. 1 taken along the line II—II.

DESCRIPTION OF THE PREFERRED EMBODIMENT

Figure 1:
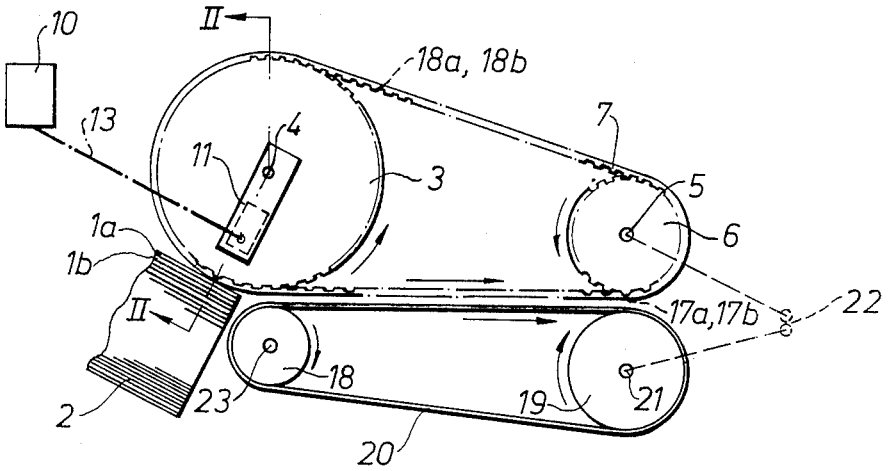

In FIG. 1 accordingly is shown schematically an arrangement in accordance with the invention for separating individual sheets 1*a*, 1*b* etc. from a stack of sheets, for example, in a magazine 2. Above the magazine 2 the arrangement has a feed pulley 3 supported so that it can rotate on a shaft 4 for rotation, with the periphery of the feed pulley in close contact with the uppermost sheet 1a. The feed pulley 3 is connected to a pulley wheel 6, mounted on a shaft 5 and driven by a motor, not shown in the drawing, by means of an endless belt 7 which runs slip-free round the two pulleys 3 and 6.

Figure 2:
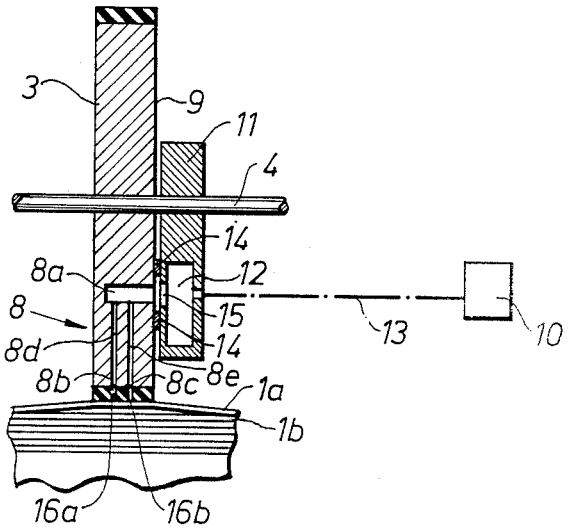

The feed pulley 3, as shown more clearly in FIG. 2, has a system of ducts 8 comprising an axial connection hole 8*a*, opening out into one side 9 of the feed pulley, which communicates with peripheral openings 8*b* and 8*c* through radial ducts 8*d* and 8*e*, respectively. On the shaft 4 a connection piece 11 is fixed, which is adjustable in its rotational position, and which comprises a chamber 12 which is joined by means of a line 13 to a source of vacuum 10, and which has an opening 15, sealed (at 14) against one side 9 of the feed pulley 3, to establish connection to the connection hole 8*a* when the feed pulley is in the position shown in FIG. 2.

In addition, the belt 7 is provided with through-perforated holes 16*a*, 16*b*; 17*a*, 17*b*; and 18*a*, 18*b* which are arranged to coincide with the peripheral openings 8*b* and 8*c* in the feed pulley 3 when the belt 7 passes round the feed pulley 3. This means that the mutual distance between the respective groups of holes in the belt 7, in the example shown, on one side must be equal to the peripheral circumference of the feed pulley 3 or an integral multiple of this circumference, and that no relative movement between the belt 7 and the feed pulley 3 may take plae. That is to say, the belt 7 must run slip-free round the feed pulley 3. This can be achieved simply by providing some kind of engagement between co-operating cogs or teeth on the feed pulley or the belt 7 or by means of other arrangements obvious to anyone versed in the art.

The arrangement further has an endless belt 20 running parallel and in the same direction below the active part of the belt 7, round pulleys 18 and 19 for receiving and conveying the sheets lifted off by means of the belt 7 in the space between the two belts, for example, to a feed station on a machine for processing or similar handling of the sheets. The pulley 19 may be mounted on a rotating shaft 21 which, for example, through a gear arrangement 22 of a known type is connected with the driven shaft 5 for power transmission, whilst the pulley 18, similarly to the feed pulley 3, may be supported on a fixed shaft 23 to rotate as the belt 20 passes.

As the feed pulley 3 rotates close to the outermost sheet 1*a* in the magazine 2, in the position as shown in FIG. 2, the sheet 1*a* will be lifted and sucked fast to the belt over the holes 16*a* and 16*b* owing to the vacuum which arises between the belt 7 and the sheet 1*a* when the connection between the connection hole 8*a* and the chamber 12 in the connection piece 11 opens, that is to say, when the mouth of the connection hole 8*a* passes on a level with the opening 15 of the chamber 12 sealed against one side 9 of the feed pulley 3. The sheet 1a so lifted will be conveyed subsequently, still sucked fast to the belt 7, by means of the belt from the magazine 2 for further transport into the nip for the belt 20 between the feed pulley 3 and the pulley 18 so as to be conveyed in the space between the two belts 7 and 20, for example, to a machine. To facilitate the freeing of the sheet 1*a* from the belt 7, the opening 15 on the connection piece transmitting vacuum is adjusted apropriately so that the vacuum connection between the connection hole 8*a* and the chamber 12 is interrupted. That is to say, the mouth of the connection hole 8*a* in the one side 9 of the feed pulley 3, has just passed to the opening 15 as the belt 7 leaves the feed pulley 3 in the nip between the feed pulley 3 and the pulley 18. The operation is repeated thereafter the next time the openings 8*b* and 8*c* coinciding with the holes 18*a* and 18*b*, respectively, in the belt 7 pass the position illustrated FIG. 2 for raising and conveying further the next sheet in the stack, that is to say the sheet 1*b* and so on.

Within the scope of the concept of the invention there are, of course, a number of practical modificiations of the embodiment described above and shown in the drawings. For example, the feed pulley 3 may have two or more equally distributed axial connection holes in connection with a corresponding number of groups of peripheral openings via radial ducts. Moreover the design of each group of such openings may vary, in shape, number and mutual location. It is conceivable, for example, to have two or more axial connection holes in close sequence after one another, and in connection with peripheral openings arranged correspondingly close to one another, so that with the help of a belt designed with corresponding holes, a successive lifting of one and the same sheet would be possible.

What is claimed is:

1. Apparatus for separating and conveying individual sheets from a stack of sheets, comprising:

a first pair of rotatable pulleys, each of said pulleys having a toothed surface, a toothed belt mounted over said pulleys and driven thereby, a second pair of pulleys mounted for rotation adjacent said first pair of pulleys, a second endless belt over said second pair of pulleys, power means for driving said first set of pulleys and said second set of pulleys, said first belt and said second belt being arranged in parallel relationship with adjacent portions of said belts advancing in the same direction upon being driven by said power means, magazine means for supporting a stack of individual sheets adjacent the periphery of one of the pulleys of said first pair of pulleys, said one pulley being a feed pulley and having a plurality of peripheral openings communicating with the periphery of said feed pulley at circumferentially spaced locations, said first belt having a plurality of holes spaced apart from each other a distance that coincides with said peripheral openings in said feed pulley, said feed pulley having a plurality of axial ducts communicating individually with said peripheral openings, a source of vacuum, and means for connecting one of said axial ducts with said source of vacuum as said feed pulley rotates when said axial duct is located adjacent said magazine means, whereby upon rotation of said pulleys, and the application of vacuum from said source, individual sheets in said magazine adhere to said first belt and are conveyed into the space between the adjacent and parallel portions of said first and second belts.

2. The apparatus according to claim 1 including a connection piece that is fixed relative to said feed pulley and includes a chamber positioned to be aligned with said axial ducts as said feed pulley rotates.

3. The apparatus according to claim 2 wherein said connection piece includes means for sealing against the leakage of fluid between said connection piece and said feed pulley, and includes a conduit connected with a source of vacuum.

4. The apparatus according to claim 2 wherein said connection piece is supported for adjustable movement about the axis of rotation of said feed pulley, whereby the circumferential location of the applied vacuum relative to said magazine means is adjustable.

5. The apparatus according to claim 1 wherein said magazine means is positioned to retain the individual sheets in said magazine by gravity.

* * * * *